US008020422B2

(12) United States Patent
Kunimoto et al.

(10) Patent No.: US 8,020,422 B2
(45) Date of Patent: Sep. 20, 2011

(54) TUBULAR PRODUCT AND MANUFACTURING METHOD AND MANUFACTURING DEVICE THEREOF

(75) Inventors: Yukitaka Kunimoto, Shizuoka-ken (JP); Toshiya Saito, Shizuoka-ken (JP)

(73) Assignee: Kabushiki Kaisha Kunitec, Shizuoka-Ken (JP)

( * ) Notice: Subject to any disclaimer, the term of this patent is extended or adjusted under 35 U.S.C. 154(b) by 720 days.

(21) Appl. No.: 12/044,414

(22) Filed: Mar. 7, 2008

(65) Prior Publication Data

US 2008/0226935 A1 Sep. 18, 2008

(30) Foreign Application Priority Data

Mar. 14, 2007 (JP) ..... 2007-064854

(51) Int. Cl.
*B21D 17/04* (2006.01)
*B21D 31/00* (2006.01)
*B21D 51/02* (2006.01)

(52) U.S. Cl. ..... 72/208; 72/220; 72/365.2; 72/370.01; 72/418; 428/600

(58) Field of Classification Search ..... None
See application file for complete search history.

(56) References Cited

U.S. PATENT DOCUMENTS 1,019,968 A * 3/1912 Koenig ..... 72/209
1,736,192 A * 11/1929 Easton ..... 220/495.08
RE18,418 E * 4/1932 Peters
1,890,077 A * 12/1932 Elting ..... 72/368
1,966,713 A * 7/1934 Flint ..... 72/69
2,059,292 A * 11/1936 Taylor ..... 72/379.6
2,207,245 A * 7/1940 Dvorak ..... 72/212
2,485,534 A * 10/1949 Mayne et al. ..... 29/889.61
3,354,682 A * 11/1967 Dupuy ..... 72/192
3,566,655 A * 3/1971 Scholten ..... 72/209
3,570,582 A * 3/1971 Calmes ..... 164/464
3,642,168 A * 2/1972 Wiley et al. ..... 206/518
3,842,635 A * 10/1974 Bibighaus ..... 72/208
3,943,867 A * 3/1976 Erfurt et al. ..... 29/463
4,006,618 A * 2/1977 Yanagimoto et al. ..... 72/11.3
5,040,399 A * 8/1991 Knapper et al. ..... 72/200
5,907,969 A * 6/1999 Soder ..... 72/370.01
2006/0065667 A1* 3/2006 Martin et al. ..... 220/676

FOREIGN PATENT DOCUMENTS

JP 57-187114 * 11/1982
JP 10-167281 * 6/1998
JP 2001-225134 8/2001
RU 2055720 * 3/1996

(Continued)

*Primary Examiner* — John J. Zimmerman
(74) *Attorney, Agent, or Firm* — Knobbe, Martens, Olson & Bear LLP

(57) ABSTRACT

A tubular product comprises a side section having outer surfaces disposed along a parallelogram and a bottom section formed on one end of the side section. The outer surfaces of the side section are pressure formed by a roller. The tubular product preferably is manufactured from a tubular material by a process comprising the use of a device having a roller that is configured to engage with a side section of the tubular material. The device also comprises a mandrel configured to position the tubular material so that the roller can apply pressure against at least a portion of the outer surfaces of the side section and can extend the side section of the tubular material to form the product.

15 Claims, 6 Drawing Sheets

FOREIGN PATENT DOCUMENTS

| | | | |
|---|---|---|---|
| SU | 387763 | * | 10/1973 |
| SU | 818682 | * | 4/1981 |
| SU | 1784323 | * | 12/1992 |
| SU | 1820537 | * | 6/1996 |

* cited by examiner

TUBULAR PRODUCT AND MANUFACTURING METHOD AND MANUFACTURING DEVICE THEREOF

CROSS-REFERENCE TO RELATED APPLICATIONS

This application claims the priority benefit of Japanese Patent Application No. 2007-064854, which was filed on Mar. 14, 2007 and which is hereby incorporated by reference in its entirety.

BACKGROUND OF THE INVENTION

1. Field of the Invention

The present invention generally relates to a tubular product, and a device and method for manufacturing the same.

2. Description of the Related Art

Conventionally, a deep drawing or metal spinning process can be used to manufacture a bottomed tubular product. One such conventional manufacturing method is described in JP-A-2001-225134.

These conventional processes and the tubular products that they produce are not without problems. For instance, when a conventional deep drawing process is used to manufacture a tubular product from a material, multiple drawing processes may be required to create the product and the product may develop flange wrinkles in the process. In addition, a drawing depth is limited when the thickness of the material is small. Moreover, the metal can easily fracture when a conventional manufacturing process is used.

SUMMARY OF THE INVENTION

An object of some embodiments of the present invention is to provide a tubular product having a smooth outer surface that does not easily fracture. Some aspects of the present invention relate to a device and method for manufacturing such a product.

According to certain features, aspects and advantages of the present invention, a tubular product having a smooth outer surface is provided that does not easily fracture. The outer surface of the side section is not scratched by a die or any other machining tool as in a conventional manner, which results in a side section that is not easily fractured.

The tubular product can be used in various ways and preferably has a side section formed from a plate material. The plate material can be formed into the tubular product using a process preferably involving rollers that apply pressure against the sides of the material, which extends the material. The side section preferably has the shape of a parallelogram, such as a rectangle, for example. However, the side section can be formed into various shapes, and various types of tubular products can be provided.

The side section of the tubular product preferably comprises outer surfaces and inner surfaces. In some embodiments, the tubular product has four outer surfaces and four inner surfaces. The four outer surfaces of the side section preferably are rolled surfaces (i.e., surfaces that have been extended by applying pressure with the roller). The four inner surfaces of the side section preferably correspond to the four outer surfaces of the side section and are unrolled surfaces (i.e., surfaces that have not been extended by applying pressure with the roller).

The bottom section and the side section preferably are integrally formed from a single plate material so that the tubular product can be easily manufactured and so that any leakage between the bottom section and the side section of the tubular product can be minimized. Further, the thickness of the plate of material (e.g., the thickness of the plate of the bottom section) can be arbitrary. The thickness of other portions of the plate material (e.g., the thickness of the portion of the plate used to form the side section) can affect the length of the tubular product.

The strength and rigidity of the tubular product also can be improved by forming projecting sections along or on a portion of the side section. The projecting sections preferably project outward on at least one outer surface among the four outer surfaces of the side section. A large number of projecting sections can be provided to a portion that requires added strength.

In some embodiments, the four outer surfaces of the side section preferably comprise a rolled surface and an unrolled surface, wherein the plate thickness in the area of the unrolled surface is larger than the plate thickness in the area of the rolled surface. For instance, a portion of the four outer surfaces of the side section can be extended by applying pressure with the roller while an unrolled surface is maintained in a portion of the four outer surfaces of the side section. A transition area preferably is provided between the rolled surface area and the unrolled surface area. The boundary area preferably extends in a direction perpendicular to the outer surface of the bottom section. In other embodiments, the boundary area preferably extends in a direction parallel to the outer surface of the bottom section. Consequently, tubular products corresponding to various types of uses can be provided. In addition, a part having differing thicknesses along the side section of the tubular product can be formed.

The tubular product can be manufactured using a method comprising positioning a tubular material with a side section in engagement with a roller and applying pressure against the side section with the roller to form the tubular product. The side section can have outer surfaces positioned along a parallelogram. The method may also further comprise engaging a mandrel with the tubular material, using the mandrel to move the tubular material between at least two rollers, and extending the tubular material to form the tubular product. The tubular material is extended preferably by applying pressure against the side section of the tubular material while the tubular material is moved between the at least two rollers, which preferably rotate in parallel with each other.

The method preferably uses a device that comprises at least two rollers positioned to rotate in parallel with each other, a mandrel inserted in a tubular material and configured to move the tubular material between the at least two rollers, and a driving section for moving the mandrel between the at least two rollers and positioning the tubular material so that a side section of the material engages with the at least two rollers. The tubular material preferably has four outer surfaces disposed along a parallelogram. The tubular material also preferably has a bottom section that is formed along one end of the side sections. The mandrel preferably has an end configured to push the bottom section of the tubular material in a generally steady manner when the mandrel is moved by the driving section. Consequently, the outer surfaces of the side section can be extended by applying pressure in a steady manner from the bottom side.

The method of manufacturing the tubular product can further comprise positioning an end of the mandrel against a bottom section of the tubular material so that the mandrel pushes the bottom section as the mandrel moves the tubular material into engagement with the roller. The roller preferably applies pressure against the tubular material to extend the side section of the tubular material and form the tubular product. In some embodiments, the roller applies pressure to a portion of the four outer surfaces of the side section leaving an unrolled surface remaining on another portion of the four outer surfaces of the side section. The pressure preferably is applied from the side section of the bottomed tubular material.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures:

FIG. 2(*b*) is a cross-sectional view taken along the line A-A of the tubular product shown in FIG. 1.

FIG. 3(*a*) corresponds to a cross-sectional view taken along the line A-A of the tubular product in FIG. 1. FIG. 3(*b*) corresponds to a vertical cross-sectional view perpendicular to the cross section taken along the line A-A.

FIG. 7(*a*) is a side view of the tubular product. FIG. 7(*b*) is a front view of the tubular product in FIG. 7(*a*).

FIG. 8(*a*) is a side view of the tubular product. FIG. 8(*b*) is a front view of the tubular product in FIG. 8(*a*).

FIG. 9(*a*) is a side view of the tubular product. FIG. 9(*b*) is a vertical cross-sectional view of the tubular product in FIG. 9(*a*).

DETAILED DESCRIPTION OF THE PREFERRED EMBODIMENT

Figure 1:
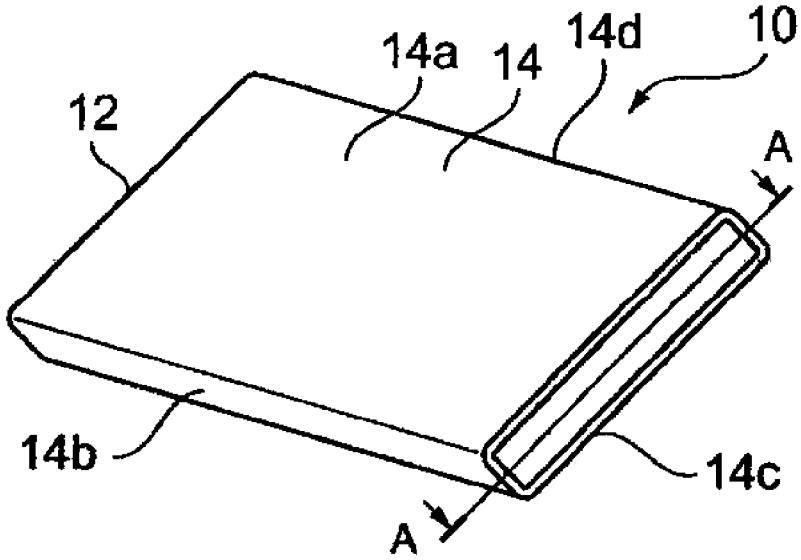
FIG. 1 is a perspective view showing an example of a tubular product arranged and configured according to certain features, aspects and advantages of the present invention.

Tubular products that are arranged and configured in accordance with certain features, aspects and advantages of the present invention comprise a side section having a tubular shape with outer surfaces disposed along a parallelogram and a bottom section formed at one end of the side section. The outer surfaces of the side section preferably are extended by applying pressure with a roller.

The term "parallelogram" should be interpreted in the broadest sense and is not limited to parallelograms in a strict sense as used in mathematics. For instance, the term "parallelogram" as used herein includes shapes that are substantially parallelograms, such as a parallelogram with round corners, a parallelogram with a partially convex side, a parallelogram with a side projecting along an area, and so forth.

The phrase "outer surfaces disposed along a parallelogram" means that the outer surfaces may be positioned at least partially along the sides of a parallelogram. The meaning of that phrase, however, is not limited to the meaning described above, but the phrase "outer surfaces disposed along a parallelogram" can also indicate that the outer surfaces are fully positioned along the sides of a parallelogram.

In some embodiments, the parallelogram is a rectangle. The term "rectangle" should be interpreted in the broadest sense and is not limited to rectangles in a strict sense as used in mathematics. For instance, the term "rectangle", as used herein, includes squares and further includes shapes that are substantially rectangles, such as a rectangle with round corners, a rectangle with a partially convex side, a rectangle with a side projecting along an area, and so forth.

The phrase "outer surfaces disposed along a rectangle" means that the outer surfaces may be at least partially positioned along the sides of a rectangle. The meaning of that phrase, however, is not limited to the meaning described above, but the phrase "outer surfaces disposed along a rectangle" can also indicate that the four outer surfaces are fully disposed along the four sides of a rectangle. Moreover, a rhombus is an example of a parallelogram.

The outer surfaces of the side section preferably are rolled surfaces (i.e., surfaces that have been extended by applying pressure with the roller). The inner surfaces of the side section preferably are unrolled surfaces (i.e., surfaces that have not been extended by applying pressure with the roller) and preferably at least partially correspond in position to the rolled surfaces of the four outer surfaces.

The bottom section and the side section preferably are integrally formed from a single plate material such that the bottomed tubular product is integrally formed. The plate material preferably is comprises aluminum or an aluminum alloy. However, the tubular product is not limited to the tubular product formed as described above and the tubular product can be made from various types of metal or other materials and from various processes.

The projecting section preferably projects outward and is formed along at least a portion of at least one outer surface among the outer surfaces of the side section. An example of the projecting section is a straight rib. The projecting section, however, may have other shapes. A number of large projecting sections preferably are provided in a part where strength is needed or desired.

The outer surfaces of the side section preferably have a rolled surface portion and an unrolled surface portion, wherein the plate thickness in the area of the unrolled surface is larger than the plate thickness in the area of the rolled surface. In this case, the boundary area, or transition region, preferably is provided between the area of the rolled surface and the area of the unrolled surface. In some embodiments, the boundary area extends in the direction perpendicular to the outer surface of the bottom section or in the direction parallel to the outer surface of the bottom section.

The method of manufacturing a tubular product according to certain features, aspects and advantages of the present invention preferably comprises forming the tubular product with a side section having outer surfaces disposed along a parallelogram. The tubular product preferably is formed from a tubular material by applying pressure with a roller, which pressure extends the side section of the tubular material. The side section of the tubular material preferably comprises four outer surfaces disposed along a parallelogram, which outer surfaces are capable of being extended when pressure is applied by at least two rollers that rotate in parallel with each other. The tubular material preferably is configured to receive a mandrel so that the mandrel can position the tubular material between at least two rollers. One end of the side section preferably comprises a bottom that can be pushed by a portion, such as an end, of the mandrel. The four outer surfaces of the side section are extended as pressure is applied by the roller, preferably from the side section with the bottom section.

In some embodiments, a part of the four outer surfaces of the side section is extended as pressure is applied by the roller, while the remaining part of the side section is an unrolled surface.

The manufacturing device for a tubular product according to certain features, aspects and advantages of the present invention comprises at least two rollers rotating in parallel with each other, a mandrel inserted in the tubular material, and a driving section that is used to moved the mandrel between the rollers. The tubular material preferably comprises a side section having four outer surfaces disposed along a parallelogram, which side section is capable of being extended as pressure is applied by at least two rollers that rotate in parallel with each other. The mandrel preferably is inserted into the tubular material and is moved by the driving section to position the tubular material between the rollers. The tubular product preferably is formed with the four outer surfaces of the side section disposed along a parallelogram.

Figure 2:
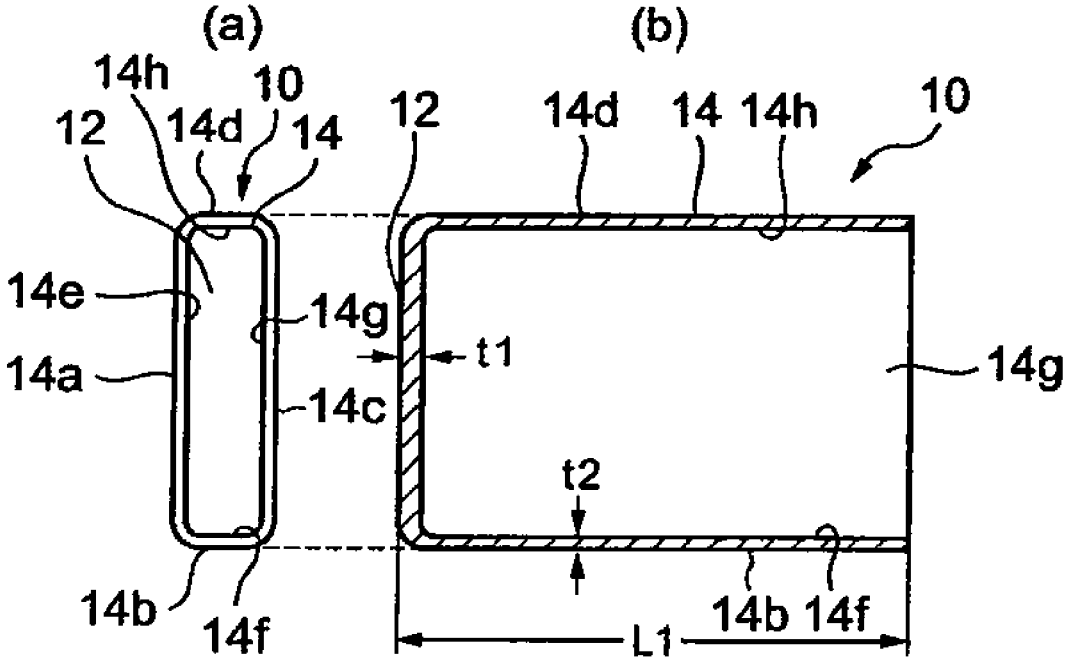
FIG. 2(*a*) is an end view of the tubular product shown in FIG. 1.

FIG. 1 is a perspective view showing an example of a tubular product 10 that is arranged and configured according to certain features, aspects, and advantages of the present invention. FIG. 2(*a*) is a side view of the tubular product shown FIG. 1 and FIG. 2(*b*) is a cross-sectional view taken along a line A-A of the tubular product shown in FIG. 1.

The tubular product 10, such as the one shown in FIG. 1, preferably comprises a bottom section 12 and a side section 14. The tubular product 10 can be formed from a tubular material 16.

The side section 14 of the tubular product 10 can be formed in a tubular shape and preferably has four outer surfaces 14*a*, 14*b*, 14*c*, and 14*d*, and four inner surfaces 14*e*, 14*f*, 14*g*, and 14*h*, respectively, all along a rectangle. The shape of the side section 14 is not limited to the shape shown in the drawing and the shape of the side section 14 also is not limited to a rectangle. The four outer surfaces 14*a*, 14*b*, 14*c*, and 14*d* of the side section 14 preferably are rolled surfaces (i.e., surfaces that are extended by applying pressure with a roller). The four inner surfaces 14*e*, 14*f*, 14*g*, and 14*h* of the side section 14 preferably are unrolled surfaces (i.e., surfaces that are not extended by the roller).

The bottom section 12 can be formed at one end of the side section 14. The other end of the side section 14 preferably is open and unobstructed. Other configurations are possible.

In some embodiments, the tubular product 10 preferably has a side section with rolled surfaces along the entire surface of each of the four outer surfaces 14*a*, 14*b*, 14*c*, and 14*d*, as shown in FIG. 1. Accordingly, the side section 14 comprises a surface structure and a cross-sectional structure formed from a rolling process. For example, the surface structure of the side section 14, as shown in FIG. 1, is a structure having an outward appearance, wherein the four outer surfaces 14*a*, 14*b*, 14*c*, and 14*d* have been extended by applying pressure with the roller. The cross-sectional structure of the side section 14, as shown in FIG. 2, is a structure showing a flow of metal, wherein the cross section of the side section 14 has been extended by applying pressure with the roller.

In some embodiments, the thickness t1 of the bottom section 12 preferably is about 0.8 mm, and the thickness t2 of the side section 14 preferably is about 0.4 to about 0.8 mm. The thickness of the bottom section 12 and the thickness of the side section 14 can be arbitrarily determined according to the properties of a desired metallic material. In addition, length L1 in the vertical direction of the side section 14 can be adjusted or determined based upon the thickness t2 of the side section 14.

Figure 3:
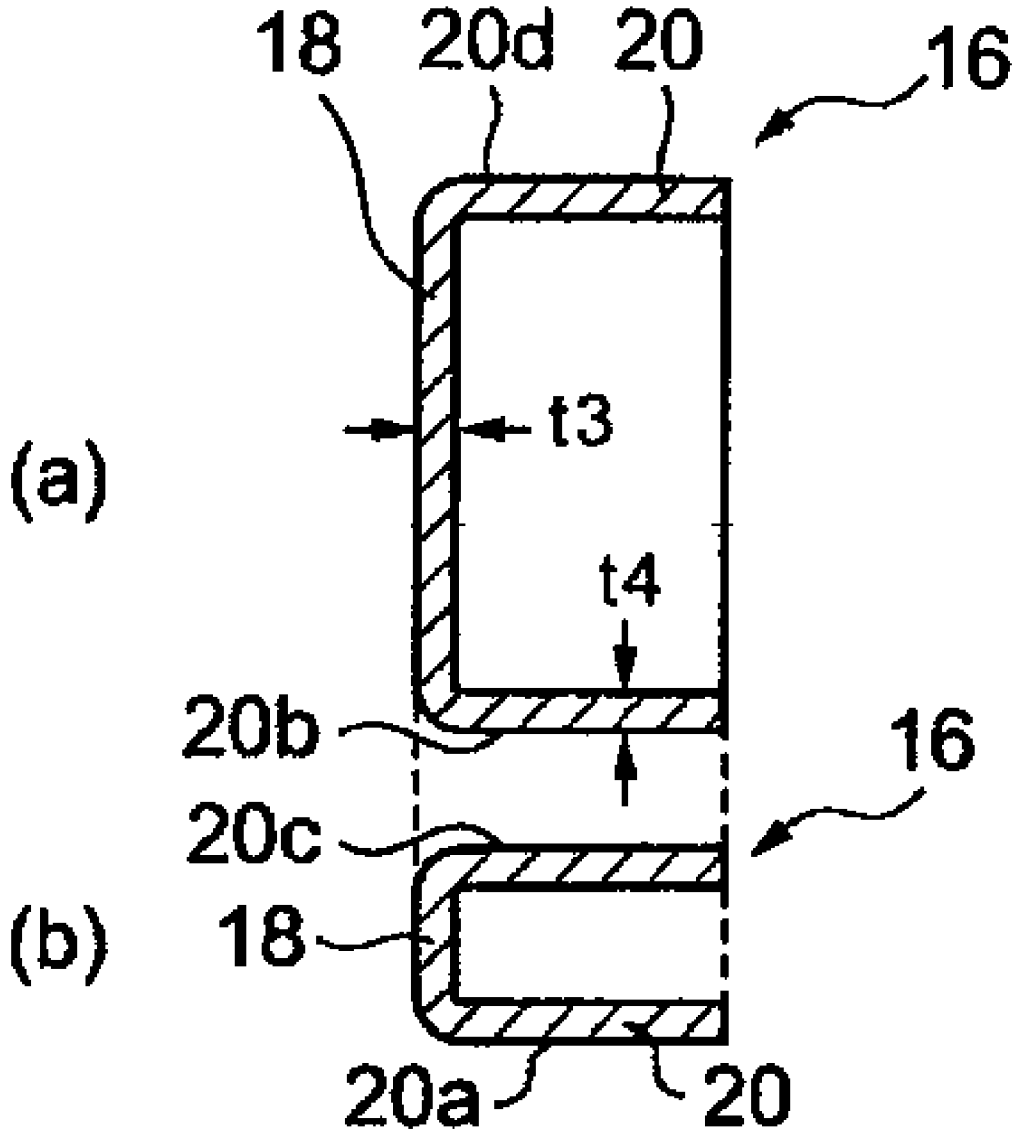
FIG. 3 is a cross-sectional view showing an example of a tubular material.

FIG. 3 is a schematic vertical cross-sectional view showing an example of a tubular material. FIG. 3(*a*) corresponds to a cross-sectional view taken along the line A-A of the tubular product in FIG. 1. FIG. 3(*b*) corresponds to a vertical cross-sectional view perpendicular to the cross section taken along the line A-A. The tubular product 10 shown in FIG. 1 and FIG. 2 can be obtained by processing the tubular material 16 according to certain features, aspects and advantages of the present invention.

The tubular material 16, such as the one shown in FIG. 3, preferably is integrally formed and comprises a bottom section 18 and a side section 20. The side section 20 preferably is formed in a tubular shape comprising four outer surfaces 20*a*, 20*b*, 20*c*, and 20*d* that are disposed along a rectangle.

The bottom section 18 preferably is formed at one end of the side section 20. The other end of the side section 20 preferably is open.

The tubular material 16 preferably is formed by a press from a source plate (not shown) made of aluminum or an aluminum alloy, for example. The tubular material 16 is not limited to the material formed in the manners explained above. The thickness of the tubular material 16 can be dictated by the thickness of the source plate. For an example, in some embodiments, the thickness t3 of the bottom section 18 and the thickness t4 of the side section 20 are both about 0.8 mm. Thus, the thickness of the source plate is about 0.8 mm for those embodiments.

Figure 4:
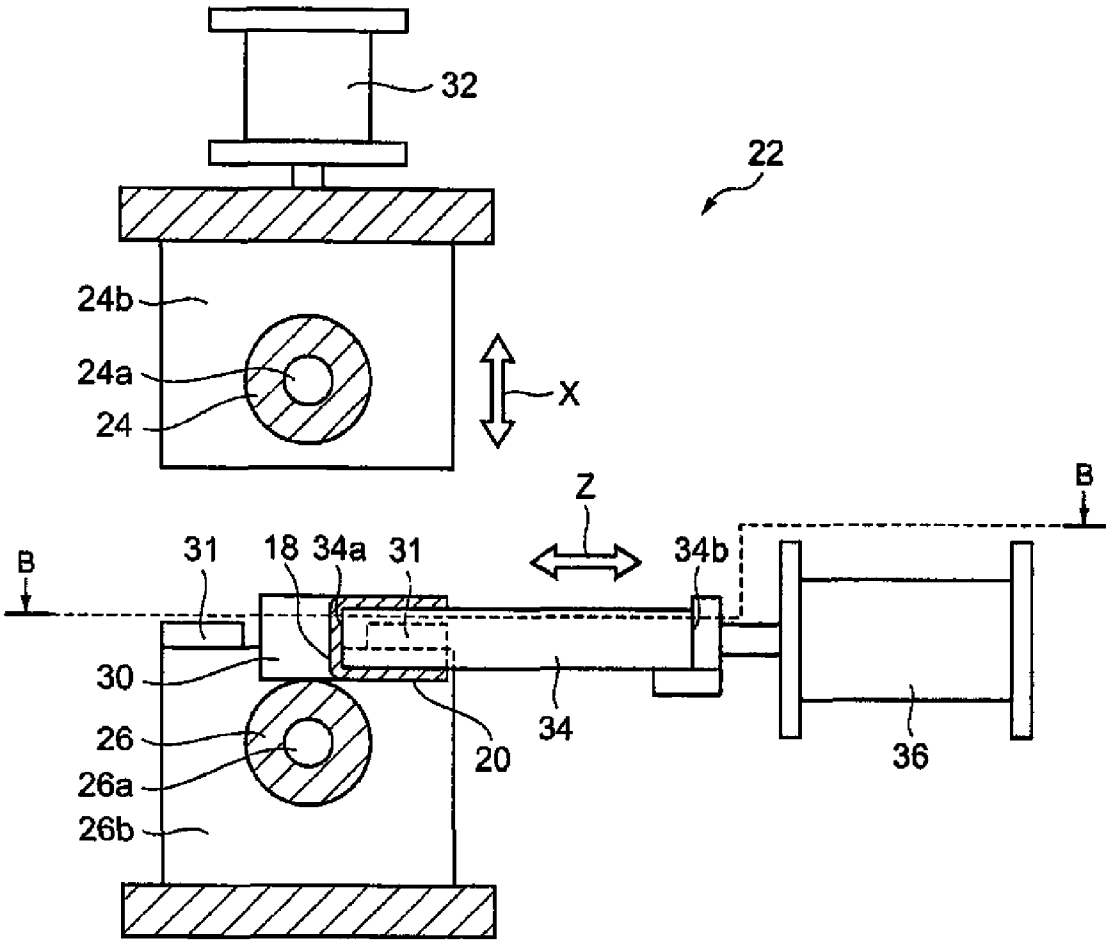
FIG. 4 is a lateral cross-sectional view of a device used to manufacture the tubular product, which view is similar to that taken along the line the line C-C of the device in FIG. 5.
Figure 5:
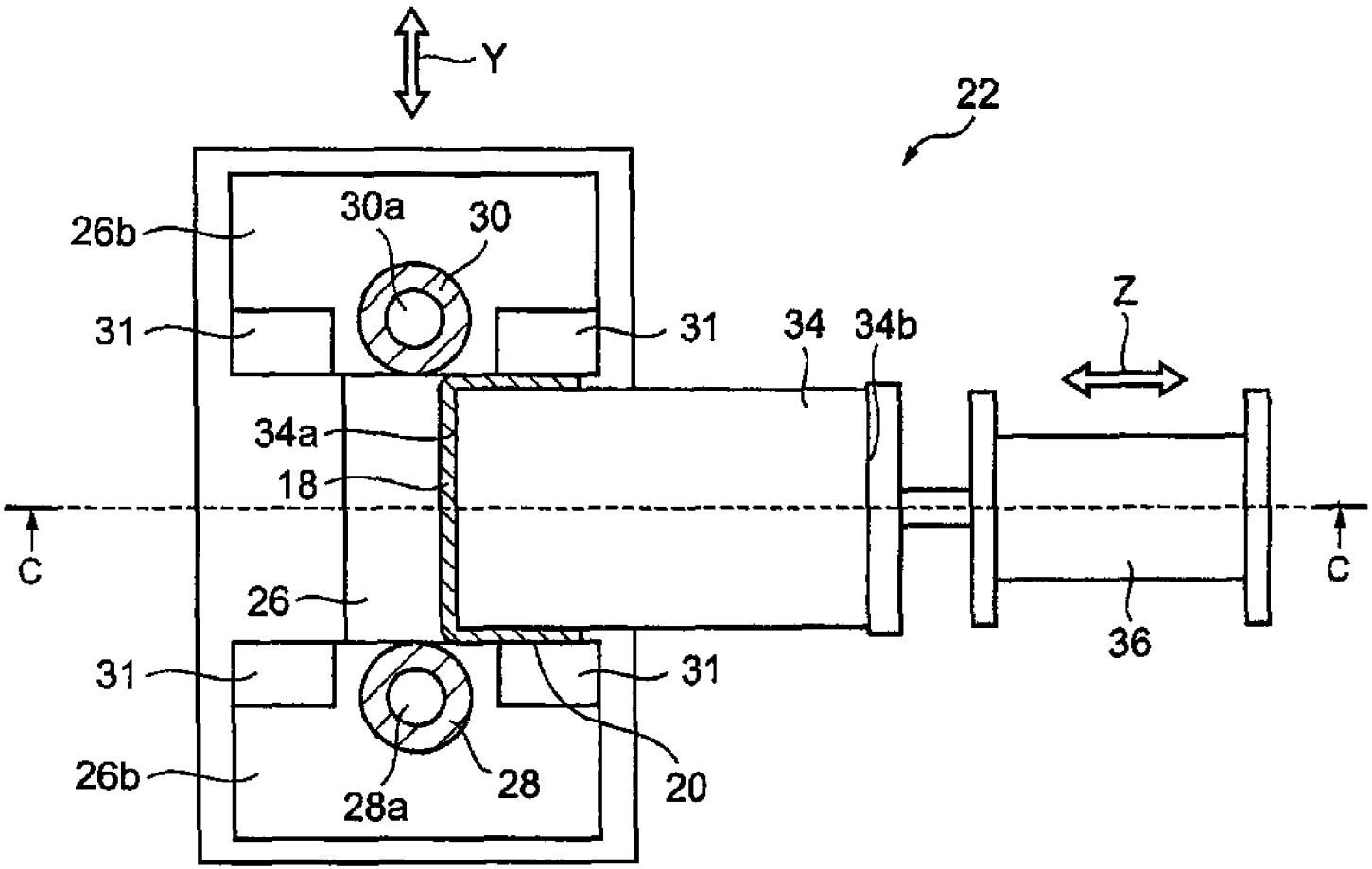
FIG. 5 shows a cross-sectional view of the manufacturing device taken along the line B-B of the device in FIG. 4.

FIG. 4 is a schematic lateral cross-sectional view showing an example of a device 22 for manufacturing the tubular product. FIG. 4 generally corresponds to a cross-sectional view taken along a line C-C in FIG. 5. FIG. 5 is cross-sectional view taken along a line B-B of the manufacturing device in FIG. 4.

The device 22 that is used to manufacture the tubular product, such as the device shown in FIG. 4, preferably comprises a first roller 24 and a second roller 26, each preferably configured to rotate in parallel with each other. The first roller 24 and the second roller 26 preferably are disposed in the vertical direction (X-direction) while being spaced apart from each other.

The first roller 24 preferably is connected to and rotatable around a first roller shaft center 24*a*, which can be supported by a first support member 24*b*. The first support member 24*b* preferably is connected to a clamp cylinder 32. The clamp cylinder 32 preferably is connected to a controller (not shown) and can move the first support member 24*b* in the vertical direction. Thus, the first roller 24 can be moved in the vertical direction by the clamp cylinder 32.

The second roller 26 preferably is connected to and rotatable around a second roller shaft center 26*a*, which can be supported by a second support member 26*b*. The second support member 26*b* preferably is fixed and is not configured to move.

A spacer 31 preferably is provided on the second support member 26*b* so that when the first support member 24*b* moves downward, the spacer 31 can come in contact with the first support member 24*b*. The spacer 31 preferably is used to set the distance between the first roller 24*a* and the second roller

26*a* and to adjust the amount of rolling in the vertical direction of the tubular material 16. In other words, the spacer 31 can be used to control a final thickness of the tubular material 16 following rolling.

In some embodiments, the manufacturing device 22 also comprises a third roller 28 and a fourth roller 30, each preferably configured to rotate in parallel with each other. The third roller 28 and the fourth roller 30 preferably are positioned in the horizontal direction (Y-direction) and are spaced apart from each other.

The third roller 28 is preferably connected to and rotatable around a third roller shaft center 28*a*, which can be supported by a third support member (not shown). The third support member can be connected to a drive mechanism (not shown) and preferably is movable in the horizontal direction (Y-direction).

The fourth roller 30 preferably is connected to and rotatable around a fourth roller shaft center 30*a*, which can be supported by a fourth support member (not shown). The fourth support member can be connected to a drive mechanism (not shown) and preferably is movable in the horizontal direction (Y-direction).

The amount of rolling in the horizontal direction of the tubular material 16 can be adjusted by moving the positions of the third roller 28 and the fourth roller 30 in the horizontal direction (Y-direction). In other words, a desired amount of rolling can be obtained by moving the rollers to predefined positions.

In some embodiments, the manufacturing device 22 also comprises a mandrel 34 configured to move forward and backward in the longitudinal direction (Z-direction). The mandrel 34 preferably has a forward end 34 that can come in contact with the bottom section 18 of the tubular material 16. The rear end 34*b* of the mandrel 34 preferably is connected to a slide cylinder 36. The slide cylinder 36 preferably is connected to a controller (not shown) and can move the mandrel 34 in the longitudinal direction (Z-direction).

When the mandrel 34 is inserted into the tubular material 16, the slide cylinder 36 can move the tubular material to the space among the first roller 24, the second roller 26, the third roller 28, and the fourth roller 30. As a result, the tubular material 16 can be positioned so that rotating the first and second rollers 24, 26 and rotating the third and fourth rollers 28, 30 can extend the four outer surfaces 20*a*, 20*b*, 20*c*, and 20*d*, respectively, when pressure is applied by the rollers against those outer surfaces. In this example, because four inner surfaces 20*e*, 20*f*, 20*g*, and 20*h* are in contact with the mandrel 34, these inner surfaces are not extended by the rollers.

Figure 6:
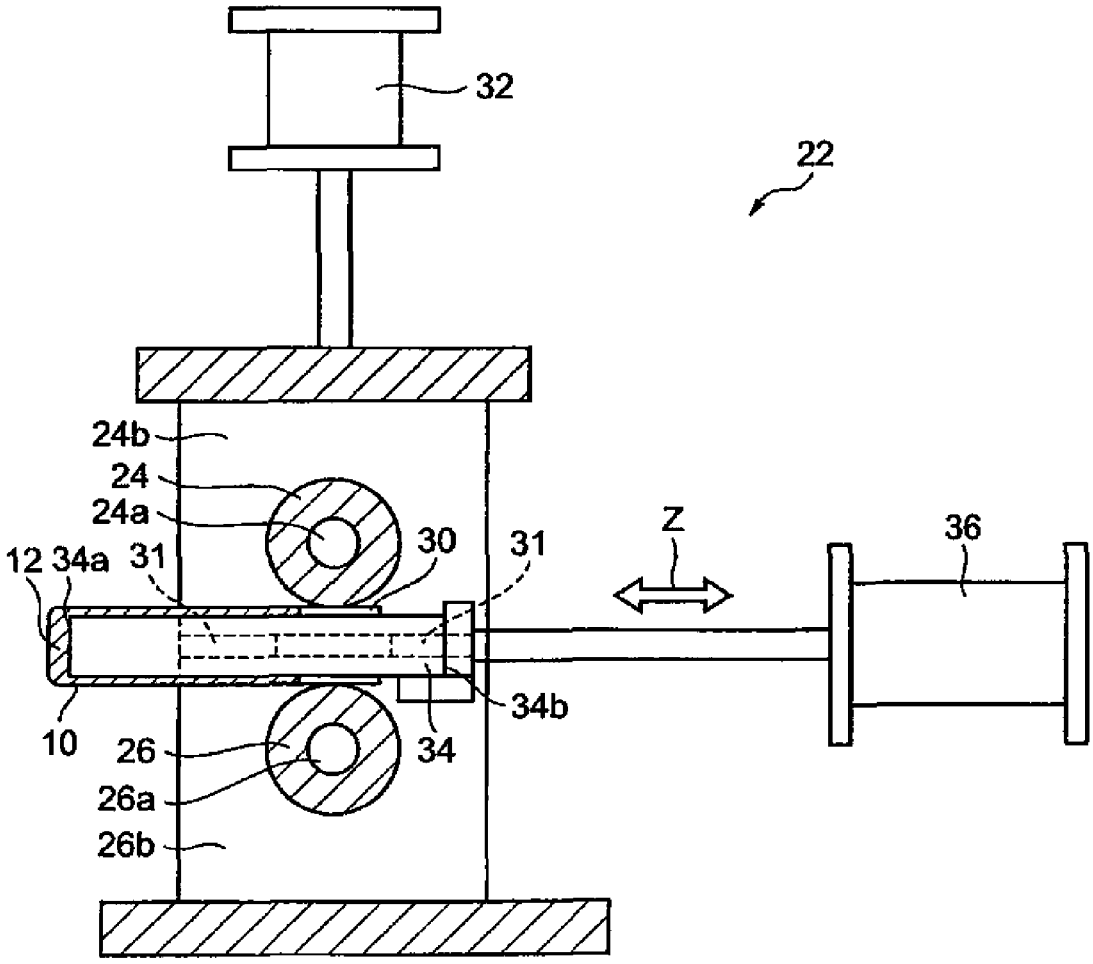
FIG. 6 shows a cross-sectional view of the tubular material having passed through the space among the rollers to form the tubular product.

The tubular product can be made using the manufacturing device 22 and applying a process illustrated in FIG. 4 to FIG. 6. For instance, the process, in one embodiment, can involve positioning a tubular material 16 on the mandrel 34, and positioning the spacer 31 and the rollers in accordance with a desired amount of rolling. The amount of rolling in the vertical direction preferably is limited by positioning the spacer 31 as a support to the second support member 26*b*. The amount of rolling in the horizontal direction preferably is determined by placing the third roller 28 and the fourth roller 30 in predefined positions.

As described above, the tubular material 16 is extended by applying pressure against the sides of the material while the material is moved in the space between the first roller 24, the second roller 26, the third roller 28, and the fourth roller 30. The tubular product 10 is manufactured as the four outer surfaces 20*a*, 20*b*, 20*c*, 20*d* of the side second 20 of the tubular material 16 are extended by pressure.

As shown in FIG. 4, when the slide cylinder 36 is driven, the tubular material 16 can be positioned between the first roller 24 and the second roller 26, and the bottom section 18 of the tubular material 16 can be pushed by the end 34*a* of the mandrel 34. The clamp cylinder 32 can be used to move the first roller 24 closer to the second roller 26. Likewise, the clamp cylinder 32 can be used to move the first support member 24*b* until it makes contact with the spacer 31 on the second support member 26*b* (not shown).

FIG. 6 shows an embodiment of the tubular product after the tubular material has passed through the space among the rollers. In some embodiments, the four outer surfaces of the tubular product preferably are smooth and not easily fractured. In contrast to conventional machining processes, such as deep drawing and spinning, the four outer surfaces 14*a*, 14*b*, 14*c*, and 14*d* of the side section 14 of the tubular product 10 are extended by applying pressure against the surfaces using the first and second rollers 24 and 26 and the third and fourth rollers 28 and 30, respectively. As a result, the four outer surfaces 14*a*, 14*b*, 14*c*, and 14*d* of the side section 14 are not scratched by a die or any other machining tool as they would be during forming in conventional manners. Thus, the side section 14 is not easily fractured.

Figure 7:
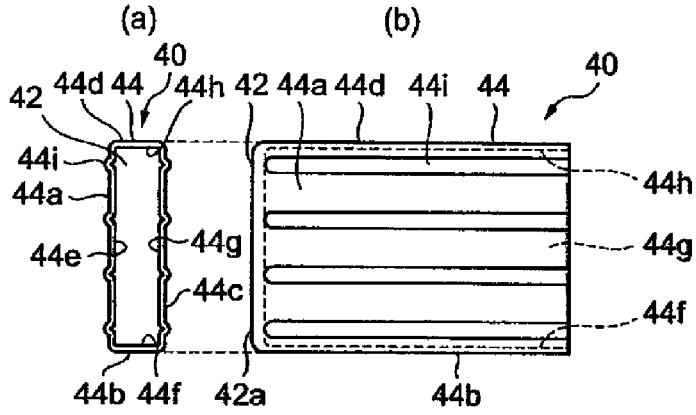
FIG. 7 shows an embodiment of a tubular product that is arranged and configured according to certain features, aspects and advantages of the present invention, wherein the tubular product comprises a side section with a plurality of straight ribs.

FIG. 7 shows another example of a tubular product that is arranged and configured according to certain features, aspects and advantages of the present invention wherein the side section comprises a plurality of straight ribs. FIG. 7(*a*) is a side view of the tubular product. FIG. 7(*b*) is a front view of the tubular product shown in FIG. 7(*a*).

A tubular product 40 preferably has a bottom section 42 and a side section 44. The tubular product 40 can be formed from the tubular material 16 shown in FIG. 3.

The side section 44 preferably is formed in a tubular shape and has four outer surfaces 44*a*, 44*b*, 44*c*, and 44*d* disposed along a substantially rectangular shape (e.g., a shape characterized in that a plurality of portions along two sides of a rectangle project in a convex shape).

The bottom section 42 preferably is formed at one end of the side section 44. The other end of the side section 44 preferably is generally open or unobstructed.

While the four outer surfaces 44*a*, 44*b*, 44*c*, and 44*d* of the side section 44 preferably are extended by applying pressure using a roller, the four inner surfaces 44*e*, 44*f*, 44*g*, and 44*h* of the side section 44 are not and are unrolled surfaces (i.e., surfaces that have not been extended by applying pressure with the roller).

In some embodiments, a plurality of straight ribs 44*i* preferably are formed on at least two outer surfaces 44*a* and 44*c* among the four outer surfaces 44*a*, 44*b*, 44*c*, and 44*d* of the side section 44. The ribs 44*i* define sections that project outward. The ribs 44*i* preferably extend in a direction generally perpendicular to the outer surface 42*a* of the bottom section 42. Thus, the rib 44*i* may be manufactured by using a mandrel having a part projecting in a corresponding manner and a roller (not shown) having a groove in a shape corresponding to the mandrel. The number of straight ribs 44*i* on the side section 44 can affect the strength of the tubular product and thus, depending on the desired strength of tubular product, additional ribs 41*i* can be added or some of the ribs 41*i* can be removed.

Figure 8:
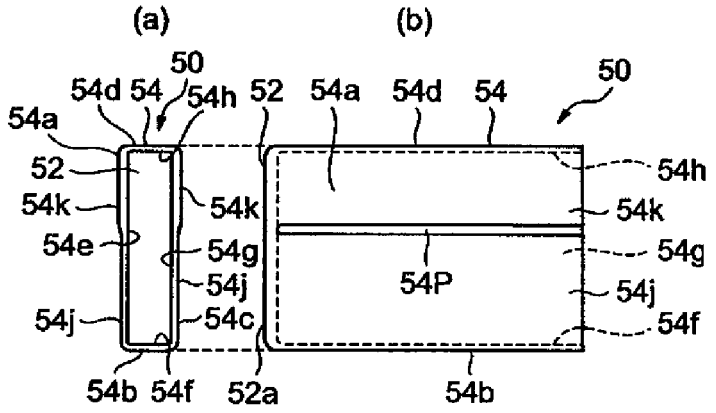
FIG. 8 shows an embodiment of a tubular product that is arranged and configured in accordance with certain features, aspects and advantages of the present invention, wherein the tubular product comprises a side section having a rolled surface and an unrolled surface.

FIG. 8 shows yet another example of a tubular product that is arranged and configured according to certain features, aspects and advantages of the present invention, wherein a portion of the side section is an unrolled surface. FIG. 8(*a*) is a side view of the tubular product. FIG. 8(*b*) is a front view of the tubular product in FIG. 8(*a*).

The tubular product 50 preferably has a bottom section 52 and a side section 54. The tubular product 50 can be formed from the tubular material 16 shown in FIG. 3, for example.

The side section 54 preferably is formed in a tubular shape and has four outer surfaces 54*a*, 54*b*, 54*c*, and 54*d* along a substantially rectangular shape (e.g., a shape characterized in that two sides of a rectangle project outward along an area).

The bottom section 52 preferably is formed at one end of the side section 54. The other end of the side section 54 preferably is open. The entire surface of the two outer surfaces 54*b*, 54*d* of the side section 54 preferably are extended by applying pressure with a roller. The other two outer surfaces 54*a*, 54*c* of the side section 54 have a rolled surface 54*j* (i.e., surfaces having been extended by applying pressure with the roller) and an unrolled surface 54*k* (i.e., surfaces not having been extended by applying pressure with the roller), respectively. The four inner surfaces 54*e*, 54*f*, 54*g*, and 54*h* of the side section 54 preferably are unrolled surfaces.

In some embodiments, a boundary or transition area 54*p* is provided between the area of the rolled surface 54*j* and the area of the unrolled surface 54*k*. The boundary area 54*p* preferably extends in the direction perpendicular to an outer surface 52*a* of the bottom section 52. The area of the rolled surface 54*j* and the area of the unrolled surface 54*k* may be manufactured by using a roller (not shown) including a large diameter corresponding to the rolled surface 54*j* and a small diameter part corresponding to the unrolled surface 54*k*. In other words, the roller may have a cam-type of configuration with a lobe or the like being defined.

As described above, a part having a different thickness can be formed along the side section of the tubular product.

Figure 9:
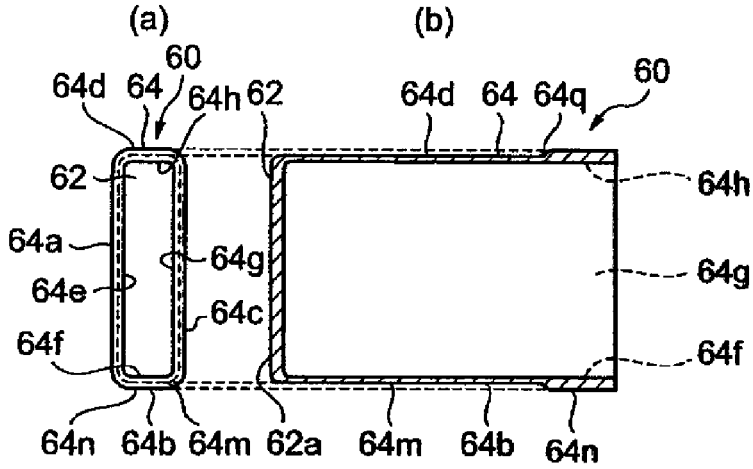
FIG. 9 shows an embodiment of a tubular product that is arranged and configured according to certain features, aspects and advantages of the present invention, wherein the tubular product comprises outer surfaces with an unrolled surface near the open end of the product.

FIG. 9 shows another example of a tubular product that is arranged and configured according to certain features, aspects, and advantages of the present invention, wherein a portion of the side section near the open end of the product comprises an unrolled surface. FIG. 9(*a*) is a side view of the tubular product. FIG. 9(*b*) is a vertical cross-sectional view of the tubular product in FIG. 9(*a*).

A tubular product 60 preferably has a bottom section 62 and a side section 64. The tubular product 60 can be formed from the tubular material 16 shown in FIG. 3.

The side section 64 preferably is formed in a tubular shape and has four outer surfaces 64*a*, 64*b*, 64*c*, and 64*d* along two rectangles of different sizes.

The bottom section 62 preferably is formed at one end of the side section 64. The other end of the side section 64 preferably is open.

The four outer surfaces 64*a*, 64*b*, 64*c*, and 64*d* of the side section 64 preferably have a rolled surface 64*m* (i.e., a surface having been extended by applying pressure with a roller) and an unrolled surface 64*n* (i.e., a surface not having been extended by applying pressure with the roller). The four inner surfaces 64*e*, 64*f*, 64*g*, and 64*h* of the side section 64 are preferably unrolled surfaces.

In some embodiments, a boundary area 64*q* is provided between the area of the rolled surface 64*m* and the area of the unrolled surface 64*n*. The boundary area 64*q* preferably extends in the direction parallel to the outer surface 62*a* of the bottom section 62. In this case, only a portion of the four outer surfaces 64*a*, 64*b*, 64*c*, and 64*d* of the side section 64 on the side of the bottom section 62 is extended by applying pressure with the roller. The unrolled surface 64*n* (i.e., the surface not having been extended by applying pressure with the roller) preferably is along part of the four outer surfaces 64*a*, 64*b*, 64*c*, and 64*d* of the side section 64 near the side of the open end. When the manufacturing device shown in FIG. 4 to FIG. 6 is used for manufacturing, the unrolled surface 64*n* is formed after the rolled surface 64*m* is formed in a portion on the side of the bottom section 62 by rolling and the four (i.e., two pairs of) rollers are moved in directions away from each other.

As described above, a part having a different thickness can be formed on the side section of the tubular product.

The present invention is not limited to the embodiments shown in the drawings. Although the present invention has been described in terms of a certain embodiment, other embodiments apparent to those of ordinary skill in the art also are within the scope of this invention. Thus, various changes and modifications may be made without departing from the spirit and scope of the invention. For instance, it is possible to manufacture tubular products having various shapes such as a shape with a rib and a shape having difference in the thickness of a plate by using mandrels and rollers of various shapes. Moreover, not all of the features, aspects and advantages are necessarily required to practice the present invention. Accordingly, the scope of the present invention is intended to be defined only by the claims that follow.

What is claimed is:

1. A method of manufacturing a tubular product, the method comprising:

positioning a tubular material with a side section in engagement with a roller, wherein the side section has four outer surfaces disposed along a parallelogram and four inner surfaces corresponding to the four outer surfaces; and applying pressure against the side section of the tubular material with the roller to form the tubular product with a projecting section formed on at least one of the four outer surfaces and a channel opposite the projecting section formed on at least one of the four inner surfaces.

2. The method of manufacturing according to claim 1, wherein the parallelogram is a rectangle.

3. The method of manufacturing according to claim 1 further comprising positioning an end of the mandrel against a bottom section of the tubular material so that the mandrel pushes the bottom section as the mandrel moves the tubular material to engage with the roller.

4. The method of manufacturing according to claim 1, wherein one end of the side section has a bottom section, and the four outer surfaces of the side section are extended as the roller applies pressure from the end of the side section with the bottom section.

5. The method of manufacturing according to claim 1, wherein the roller applies pressure to a part of the four outer surfaces of the side section leaving an unrolled surface remaining on the four outer surfaces of the side section.

6. A method of manufacturing a tubular product, the method comprising:

providing a tubular material with a side section, wherein the side section has four outer surfaces along a parallelogram and four inner surfaces corresponding to the four outer surfaces;

engaging a mandrel with the tubular material;

moving the tubular material with the mandrel between at least two rollers, wherein the rollers rotate in parallel with each other; and extending the tubular material to form the tubular product by applying pressure against the tubular material while the tubular material is moved between the at least two rollers;

wherein the tubular product has a projecting section formed on at least one of the four outer surfaces and a channel opposite the projecting section formed on at least one of the four inner surfaces.

7. The method of manufacturing according to claim 6, wherein the parallelogram is a rectangle.

8. The method of manufacturing according to claim 6 further comprising positioning an end of the mandrel against a bottom section of the tubular material so that the mandrel pushes the bottom section as the mandrel moves the tubular material to engage with the at least two rollers.

9. The method of manufacturing according to claim 8, wherein the at least two rollers apply pressure against the tubular material to extend the side section of the tubular material and form the tubular product.

10. The method of manufacturing according to claim 8, wherein the roller applies pressure to a part of the four outer surfaces of the side section leaving an unrolled surface remaining on the four outer surfaces of the side section.

11. The method of manufacturing according to claim 6, wherein one end of the side section has a bottom section, and the four outer surfaces of the side section are extended as the at least two rollers apply pressure from the end of the side section with the bottom section.

12. The method of manufacturing according to claim 6, wherein the at least two rollers apply pressure to a part of the four outer surfaces of the side section leaving an unrolled surface remaining on the four outer surfaces of the side section.

13. A manufacturing device for a tubular product, comprising at least two rollers positioned to rotate in parallel with each other, a mandrel inserted in a tubular material and configured to move the material between the at least two rollers, wherein the tubular material has four outer surfaces disposed along a parallelogram and four inner surfaces corresponding to the four outer surfaces, and a driving section for moving the mandrel between the at least two rollers and positioning the tubular material so that a side section of the material engages with the at least two rollers to form a projecting section on at least one of the four outer surfaces and a channel opposite the projecting section on at least one of the four inner surfaces.

14. The manufacturing device according to claim 13, wherein the parallelogram is a rectangle.

15. The manufacturing device according to claim 13, wherein the tubular material has a bottom section that is formed on one end of the side section, and the mandrel has an end configured to push the bottom section of the tubular material when the mandrel is moved by the driving section.

* * * * *